US008388074B1

(12) United States Patent
Donberger et al.

(10) Patent No.: US 8,388,074 B1
(45) Date of Patent: Mar. 5, 2013

(54) KITCHEN APPLIANCE HAVING AN ADJUSTABLE DOOR PANEL

(75) Inventors: Travis Donberger, Evansville, IN (US); Eric R. Meyerholtz, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 377 days.

(21) Appl. No.: 12/504,728

(22) Filed: Jul. 17, 2009

(51) Int. Cl.
*A47B 97/00* (2006.01)

(52) U.S. Cl. ..... 312/204; 312/405

(58) Field of Classification Search ..... 312/405, 312/204, 348.4; 403/326, 329
See application file for complete search history.

(56) References Cited

U.S. PATENT DOCUMENTS

| | | | | |
|---|---|---|---|---|
| 4,514,021 | A | 4/1985 | Sundermeier et al. | |
| 4,558,503 | A | 12/1985 | Wilson | |
| 4,970,874 | A * | 11/1990 | Solak et al. | 312/116 |
| 5,048,233 | A | 9/1991 | Gidseg et al. | |
| 5,358,326 | A * | 10/1994 | Cherry et al. | 312/405 |
| 6,390,576 | B1 | 5/2002 | Walburn | |
| 6,536,856 | B2 | 3/2003 | Pelizzari et al. | |
| 6,561,605 | B1 * | 5/2003 | Akers | 312/348.1 |
| 7,014,281 | B2 * | 3/2006 | Wuestefeld et al. | 312/204 |
| 7,665,810 | B2 * | 2/2010 | Crompton et al. | 312/204 |
| 7,770,985 | B2 * | 8/2010 | Davis et al. | 312/204 |
| 2004/0222725 | A1 * | 11/2004 | Park et al. | 312/405 |
| 2005/0023940 | A1 * | 2/2005 | Van Beusekom | 312/138.1 |
| 2005/0160746 | A1 * | 7/2005 | Kwon | 62/125 |
| 2007/0188059 | A1 | 8/2007 | Davis et al. | |
| 2009/0045705 | A1 * | 2/2009 | Laible et al. | 312/204 |

FOREIGN PATENT DOCUMENTS

| | | | |
|---|---|---|---|
| CN | 101131293 | A | 2/2008 |
| EP | 0647821 | A1 * | 4/1995 |
| EP | 0718459 | B1 | 4/2003 |
| EP | 1366703 | B1 | 5/2004 |
| GB | 2050814 | A | 1/1981 |

OTHER PUBLICATIONS

Jenn-Air Bottom Mount Built-In Refrigerator Installation Guide Jenn-Air W10231367A Published Mar. 2009 64 Pages.

* cited by examiner

*Primary Examiner* — Hanh V Tran
(74) *Attorney, Agent, or Firm* — Kirk W. Goodwin; Diederiks & Whitelaw PLC

(57) ABSTRACT

A kitchen appliance includes a cabinet with an access opening with a door proximate to the opening. A panel is adjustably attached to a bracket on the back side of the panel and the bracket is adjustably attached to the top edge of the door. The bracket provides for attachment of the panel to the door as well as vertical, horizontal and rotational adjustment of the panel in relation to the door.

16 Claims, 12 Drawing Sheets

KITCHEN APPLIANCE HAVING AN ADJUSTABLE DOOR PANEL

BACKGROUND OF THE INVENTION

This present invention pertains to the art of kitchen appliances and, more particularly, to mounting and adjusting a panel in multiple directions in relation to a kitchen appliance door.

SUMMARY OF THE INVENTION

The present invention relates to a kitchen appliance that includes a cabinet with an access opening. Associated with the access opening is a door, the door having edges, including at the top of the door.

In one embodiment, a panel for a kitchen appliance, having a front and a back side, is provided. A top bracket is adjustably attached to the top edge of the door, and is also adjustably attached to the back side of the panel. The top bracket attachment to the door provides top bracket door adjustment of the panel in relation to the door. This top bracket door adjustment to the door includes vertical adjustment as well as rotational adjustment. The top bracket attachment to the panel provides top bracket panel adjustment of the panel in relation to the door including for horizontal adjustment. The bracket door adjustment may include at least two pins, which are secured to the door. These pins may be threaded bolts which are rotationally secured to the door by nuts. The panel door adjustment may include a slidable attachment to the panel, and this may be by a slot and this slot may include a keyhole portion. The appliance may also include a bottom bracket that is attached to the door as well as to the back side of the panel or the appliance may include a bottom hinge that is attached to the cabinet and the door is mounted on this hinge and the panel is further attached to this hinge. The appliance may also include a retention member in the panel, as well as a handle that is attached to the front panel through the retention member.

In another embodiment the appliance, has a door, an external panel and a bracket between them. The bracket is adjustably engaged to the panel, as well as to the door. The adjustable engagement of the bracket to the panel and the door allows for adjustment of the panel in relation to the door. The engagement to the panel may allow for substantially horizontal adjustment, include by using a slot that may include a keyhole or through other ways of sliding the panel in relation to the door. The engagement to the door may allow for substantially vertical adjustment, include by rotating an element of the engagement. The combination of the engagement of the door to the bracket and the bracket to the panel may allow for vertical, horizontal and rotational adjustment of the door in relation to the panel.

The present invention allows for attaching a panel to a kitchen appliance door by providing: a plurality of pins at the top of a kitchen appliance door; a plurality of protrusions on a back side of a panel, and a bracket having a pin receiving portion and a protrusion receiving portion. Then one can, in no particular order, engage the bracket to the pins and protrusions and adjust the panel substantially vertically, in relation to the door, by changing the orientation of the protrusions in relation to the bracket, and adjusting the panel substantially horizontally and rotationally, in relation to the door, by changing the orientation of the pins in relation to the bracket. The protrusion receiving portion may include a slot and the step of changing the orientation of the protrusions in relation to the bracket may include sliding the protrusion receiving portion substantially horizontal to the protrusions. The pins may be threaded, and the step of engaging the bracket to the door may include threading at least one nut to the threads of the pins and adjusting the panel substantially horizontally and rotationally in relation to the door by rotating the nut about the threads of the pin. A single spacer block may be provided to assist in accomplishing: a flush fitting of a front face of the panel to a front face of a kitchen opening edge; a desired gap between a side edge of the panel to the side edge of the kitchen opening; as well as a desired gap between the panel and the door.

These and other features, advantages and objects of the present invention will be further understood and appreciated by those skilled in the art by reference to the following specification, claims and appended drawings.

DETAILED DESCRIPTION OF PREFERRED EMBODIMENT

Figure 1:
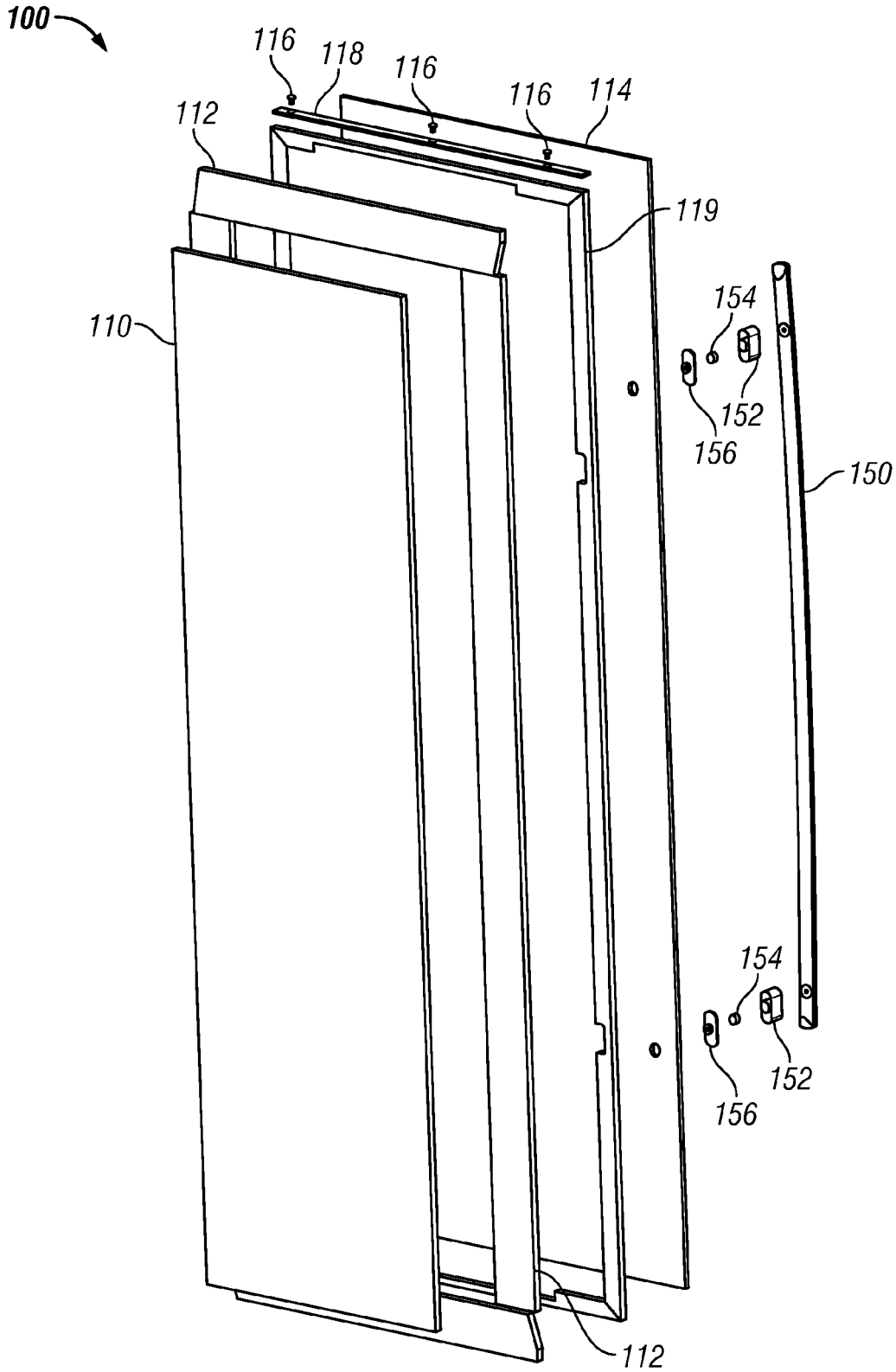
FIG. 1 is a partially exploded view of a door panel embodying the present invention.

With initial reference to FIG. 1, a door panel is generally indicated at 100. Door panel 100 includes filler foam board 110 which has stud member 112 (which may be made of wood) substantially about its perimeter. This is housed in door skin 119 (viewed from the back side) is a substantially flat panel on the front side and has multiple bends about the edges to cover at least a portion of the edge of stud member 112. Front façade 114 may be made of glass and is affixed to the front. One skilled in the art will appreciated that various methods can be used to assemble glass to the door, include including that taught in US Patent Application US2007/0188059, Ser. No. 11/353,945 entitled "Kitchen Appliance Having Floating Glass Panel" and is hereby incorporated by reference. Panel cover 118 may be attached by panel cover fasteners 116 (such as screws) and may assist in holding front façade 114 to the panel 100. Handle 150 may be attached to panel 100 by door fastener 154 (such as screws). It may be preferable to include a handle stand-off 152 as well as a handle spacer 156 at one or more connection points of handle 150 to panel 100.

In some embodiments, door fastener 154 may be attached to stud member 112 of panel 100. This may assist in keeping panel 100 rigid and tight to the door (not shown) when handle 150 is pulled to open, or move the door. In other embodiments a separate retention stud may be used to increase rigidity.

Figure 2:
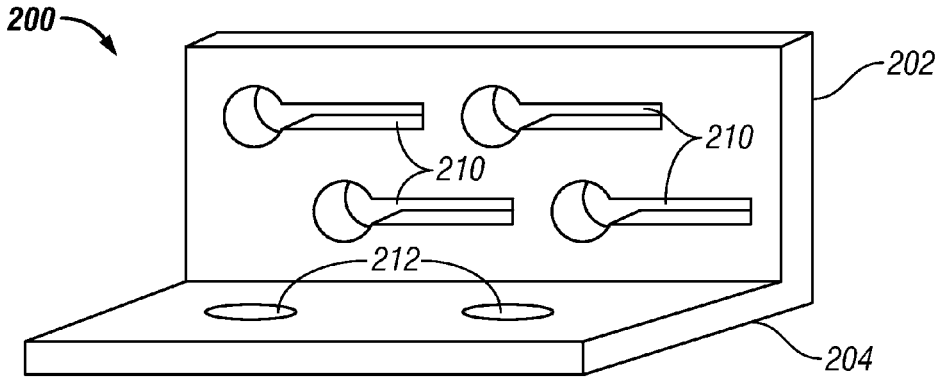
FIG. 2 is a drawing of an embodiment of a bracket which can be used in the present invention to attach the panel to the door.

With reference to FIG. 2, a bracket is generally indicated at 200. Bracket 200 includes a panel attachment portion, generally indicated at 202 and a door attachment portion, generally indicated at 204. Panel attachment portion 202 is shown including includes protrusion receiving area 210. In this example a slot with a keyhole portion is shown. One skilled in the art will appreciate that any portion capable of receiving and allowing for engagement of a protrusion member from a panel will suffice. Door attachment portion 204 is shown including pin receiving area 212. As with the protrusion receiving area 210, the including pin receiving area 212 can be any portion capable of receiving and allowing for engagement of a pin.

Figure 3:
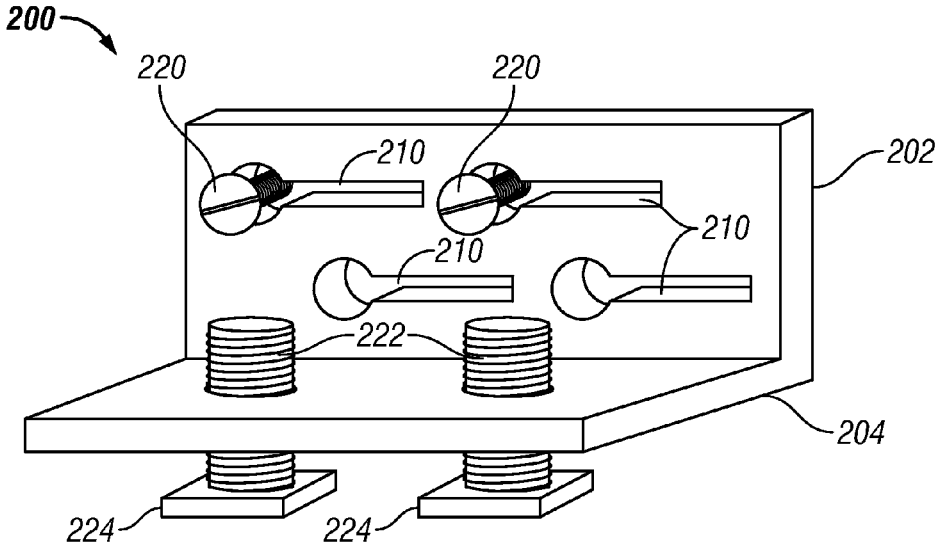
FIG. 3 is a drawing of an embodiment of a bracket which can be used in the present invention to attach the panel to the door including certain attachment hardware.

With reference to FIG. 3, bracket 200 has protrusions 220, in this example these protrusions are screws, which extend through the protrusion receiving area 210. One skilled in the art will appreciate that these protrusions need not be limited to screws, but any element that can be received in the pin receiving area 212 and facilitate engagement can be substituted for protrusions 220. In the present embodiment protrusion receiving area 210 is a slot with a keyhole portion. The keyhole portion allow for protrusions 220 to be inserted into protrusion receiving area 210 and then secured by tightening of the screw against panel attachment portion 202 of bracket 200. The slot also facilitates horizontal movement of a panel (not shown in FIG. 3) attached to bracket 200 in relation to the door (not shown) (also attached to bracket 200) which will be discussed in greater detail later in this application.

Pin 222 is inserted through pin receiving area 212 and is engaged by pin adjustment member 224, a bolt and nut combination in this present example. Pin adjustment member 224 can be rotatably tightened to adjust the panel in relation to the door (not shown in FIG. 3). One skilled in the art will appreciate that any member that is capable of being received through pin receiving area 212 and then adjusted against door attachment portion 204 of bracket 200 can be substituted for pin 222. As shown, pin adjustment member 224 rotatably engages pin 222 and contacts the bottom of bracket 200. When pin adjustment member 224 is rotated while in engagement with the pin, pin adjustment member 224 moves in relation to the pins, thereby causing bracket 200 to move in relation to pin 222 due to the contact between pin adjustment member 224 and bracket 200. This facilitates adjustment of panel 100 in relation to door 300, as discuss later in this present application. As shown in the present embodiment two pins 222 are bolts and are coupled with two pin adjustment members 224, which are nuts and are used to secure the door to door attachment portion 204 of bracket 200. These nuts permit both vertical as well as rotational adjustment of the panel in relation to the door, as discussed below.

Figure 4:
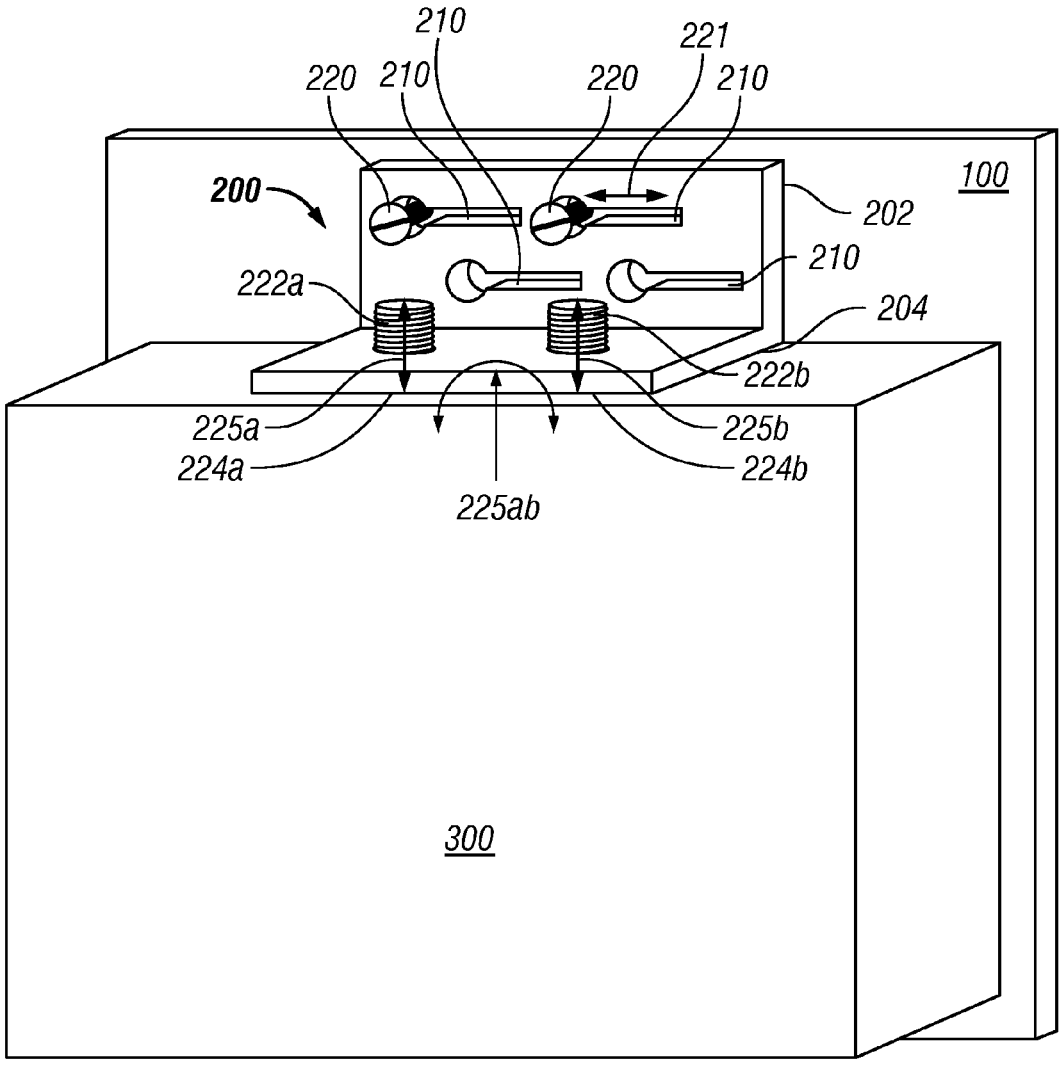
FIG. 4 is a drawing, from the rearward orientation, of an embodiment of the bracket being attached to a door and to a panel using the hardware and the horizontal, vertical and rotational adjustment methods.

With reference to FIG. 4, a portion of a door is generally shown at 300 and a portion of a panel is generally shown at 100. More specifically the back side of panel 100 is generally shown and the back side, or portion most proximate to the access opening of the appliance, is shown for door 300.

Movement in the substantially horizontal direction is depicted generally by arrow 221. This depicts the movement of panel 100 in relation to bracket 200 (and thereby to door 300) in the substantially horizontal direction 221. In this present embodiment the protrusions 220 can slide in the slots of protrusion receiving area 210. This sliding facilitates horizontal adjustment. Once properly adjusted in the substantially horizontal direction 221, protrusions 220 can be tightened to secure the panel in proper alignment. Another aspect of the present invention is that it allow for correcting both misaligned doors and incorrectly aligned door. Embodiments of this invention allows an installer of the panel to correct mistakes they make, correct mistakes a prior installed made or even correct misalignment that may occur over periods of time. As shown in the present embodiment, it may be advisable to provide a plurality of protrusion receiving areas 210 so the that desired one might be used in relation to a protrusion member based on gross alignment through selection of the desired protrusion receiving areas 210 to use and subsequently use the sliding method described above for precise alignment in the substantially horizontal direction 221.

Movement in the substantially vertical direction is depicted generally by arrows 225*ab* (collectively 225). This depicts the movement of panel 100 in relation to bracket 200 (and thereby to door 300) in substantially vertical direction 225. In this present embodiment, rotation of pin adjustment member 224*a* (While not visible in FIG. 4, as they are between bracket 200 and door 300, their respective locations are generally indicated by 224*a* and 224*b*. One skilled in the art will appreciate that one could use a tool inserted between bracket 200 and door 300 to adjust pin adjustment member 224.) causes adjustment substantially vertical direction 225*a* of panel 100 in relation to door 300. Accordingly rotation of pin adjustment member 224*b* causes adjustment substantially vertical direction 225*b* of panel 100 in relation to door 300. When both pin adjustment member 224*a-b* are equally rotated then movement causes equal adjustment in substantially vertical direction 225. However, if one of pin adjustment member 224*a-b* are rotated more than the other, a rotational adjustment, generally depicted by arced arrow 225*ab*, will occur. Therefore, the combination of two pins 222 *a-b* and pin adjustment members 224 allow for both vertical and rotational adjustment.

Figure 5:
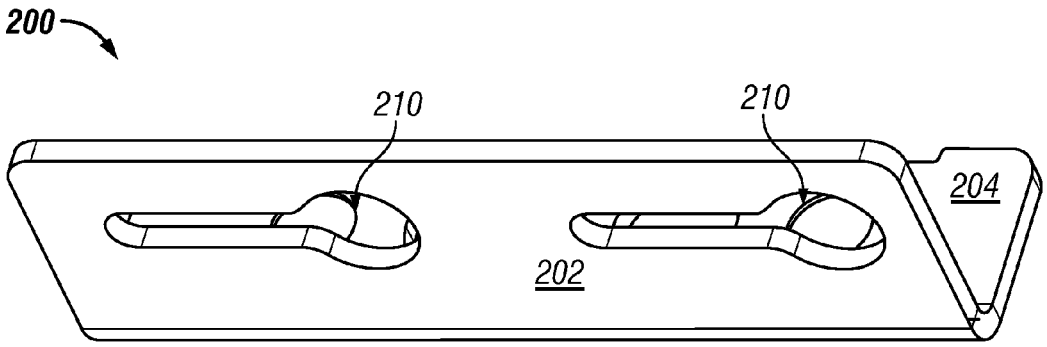
FIG. 5 is a perspective view of a bracket embodiment of the present invention showing the panel attachment portion.

With reference to FIG. 5, an alternative embodiment of bracket 200 is depicted. Only two protrusion receiving areas 210 are utilized in this embodiment. Panel attachment portion is shown and generally depicted at 202. Door attachment portion, generally depicted at 204, is partially shown.

Figure 6:
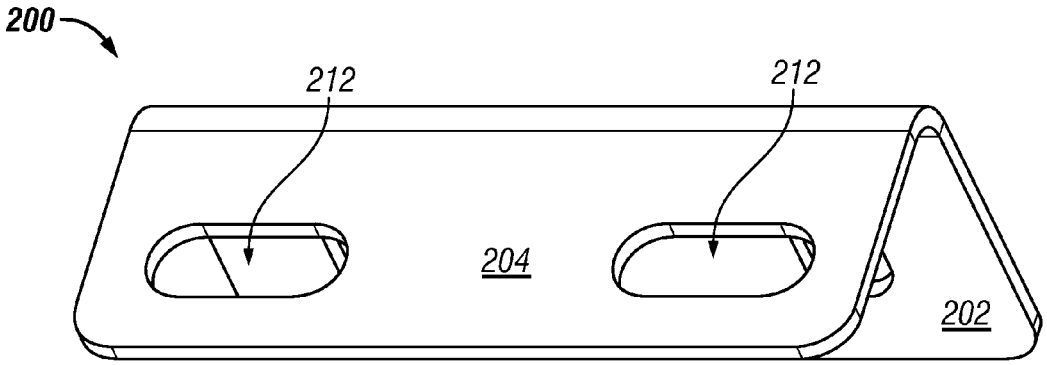
FIG. 6 is a perspective view of a bracket embodiment of the present invention showing the door attachment portion.

With reference to FIG. 6, an alternative embodiment of bracket 200 is depicted. In this embodiment, pin receiving areas 212 are slots. This may allow for additional adjustment of the panel in relation to the door as well a facilitate alignment of predrilled pin retaining holes (not shown). Door attachment portion is generally depicted at 204. Panel attachment portion, generally depicted at 202, is partially shown.

Figure 7:
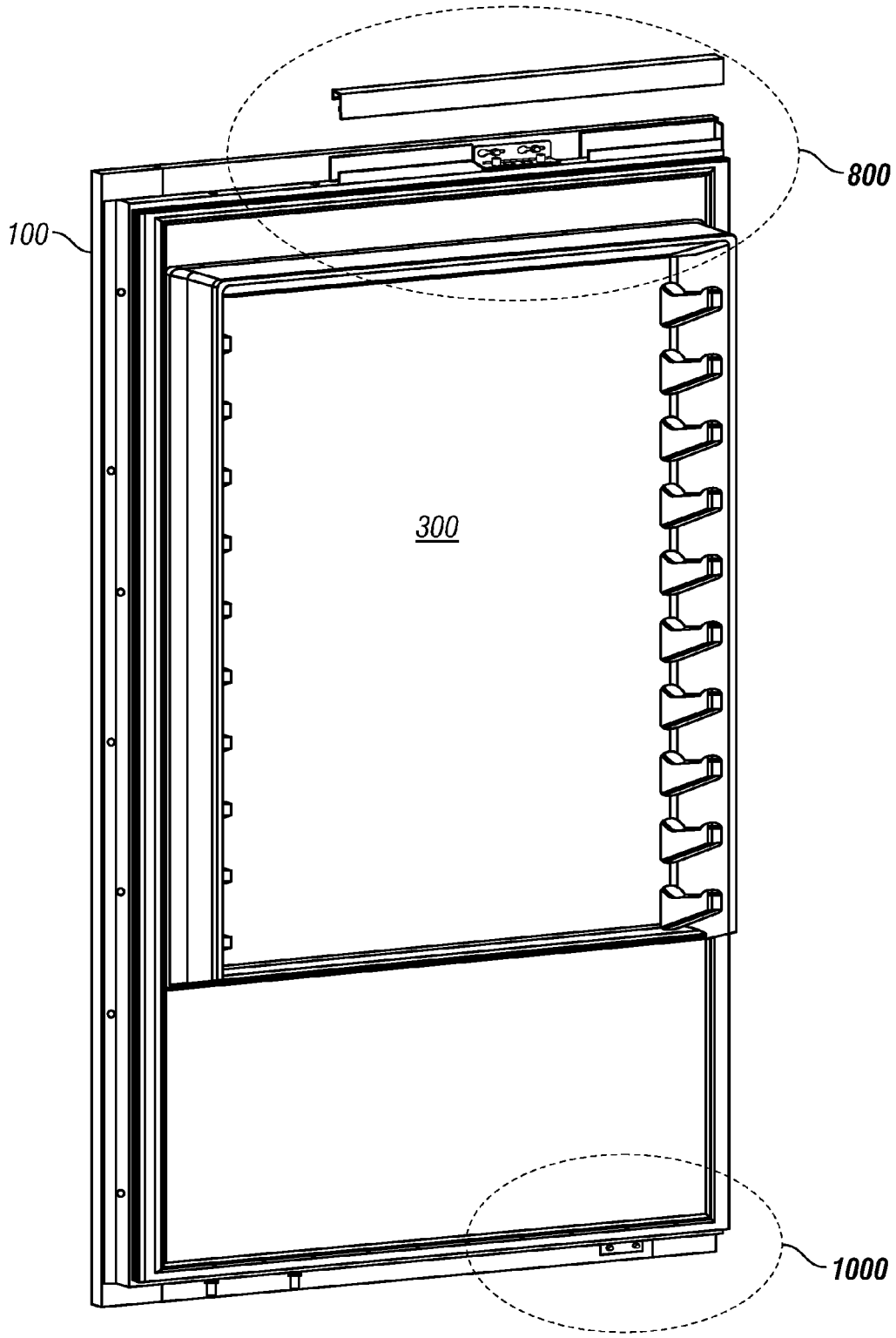
FIG. 7 is a perspective view showing an embodiment of the door, panel, and upper and lower bracket regions.

With reference to FIG. 7, a perspective view of an embodiment of door of the present invention is generally depicted at 300. The panel is generally depicted at 100. Upper bracket region is generally depicted at 800 while the lower bracket region is generally depicted at 1000.

Figure 8:
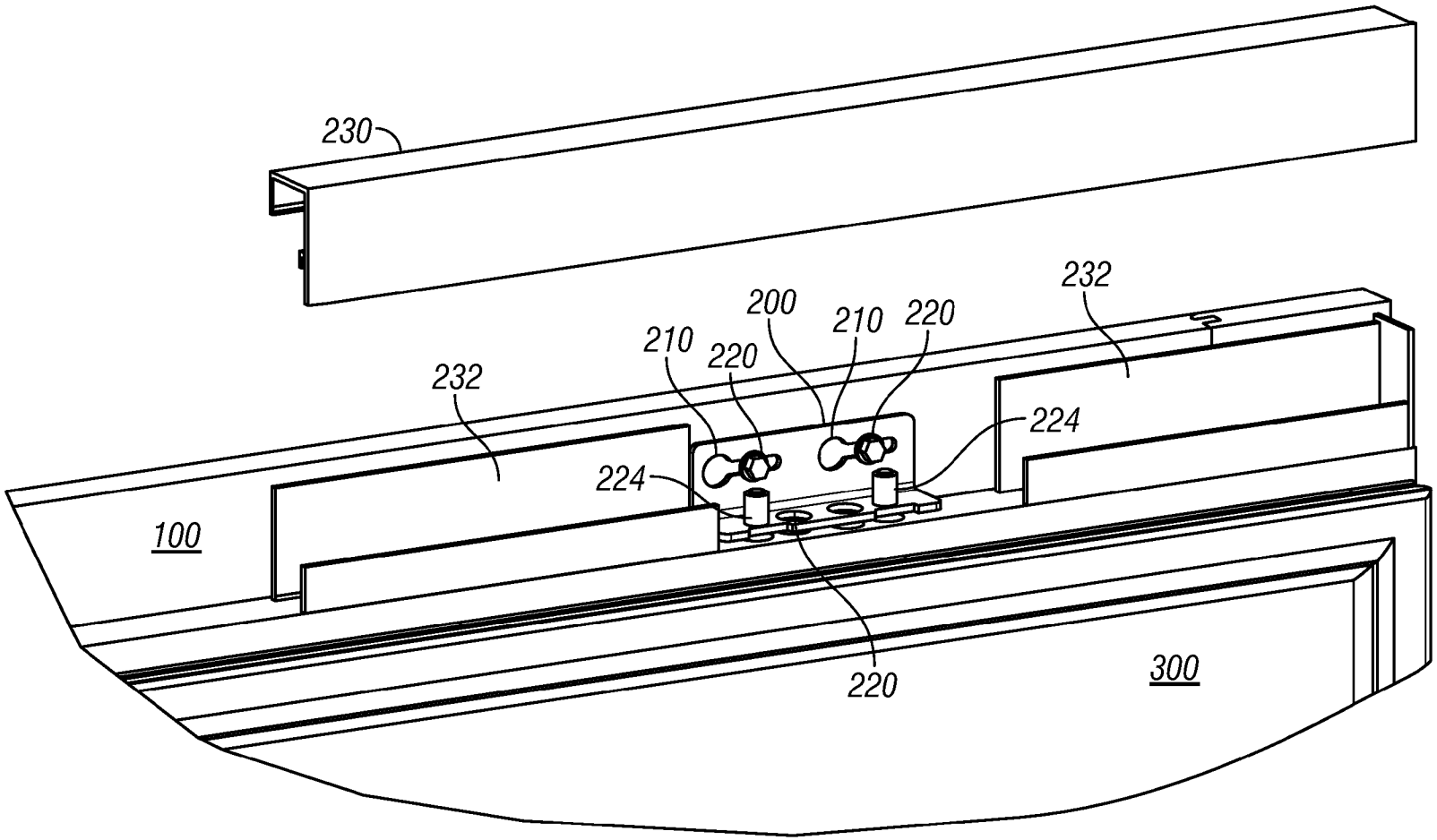
FIG. 8 is a perspective view showing an embodiment of the upper bracket region.

With reference to FIG. 8, a perspective view showing an embodiment of the upper bracket region is shown. Panel 100 is generally depicted at 100 and door 300 is generally depicted at 300. Bracket 200 is shown attached to panel 100 by protrusions 220 which are insert through protrusion receiving portion 210. Pins 222 are each inserted through bracket 200 through a corresponding one of the plurality of pin receiving portions 212. In this embodiment pins 222 are covered and thereby hidden in this view by pin adjustment members 224. A cover 230 may used to cover the entire bracket assembly. In this embodiment cover 230 is matingly engaged to cover receiver member 232.

Figure 9:
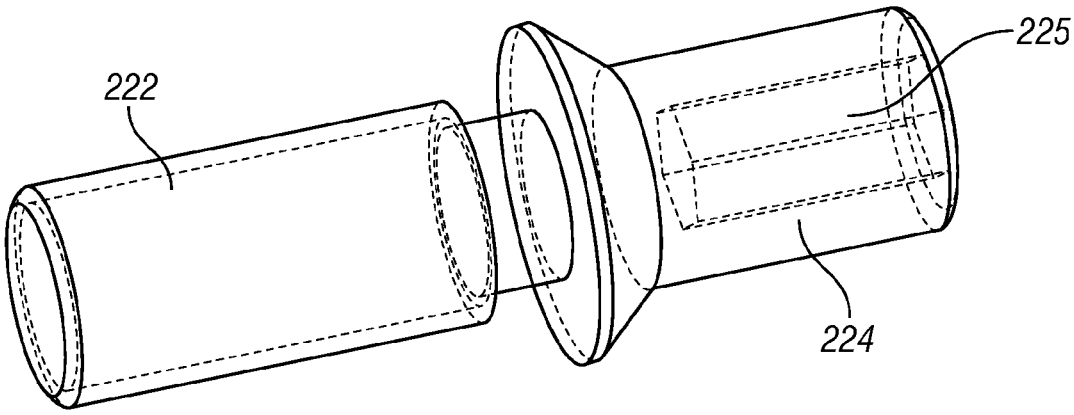
FIG. 9 is a perspective view showing an alternative embodiment of a pin and a pin engagement member.

With reference to FIG. 9, an alternative embodiment of pin 222 and pin adjustment member 224 is depicted. This configuration allows for a tightening tool to be inserted into pin tightening region 225 and may facilitate clearance of tools used to rotation pin engaging member 224. This embodiment utilizes the pin adjustment member 224 as both an adjustment member and also as part of pin 222 functionality. Therefore, one skilled in the art will appreciate that in this present invention pin 222 and pin adjustment member 224 may be multiple parts with separate functionalities, multiple parts with shared functionalities or it may even be a single part. Additionally the pin may be threaded internally, externally or a combination thereof.

Figure 10:
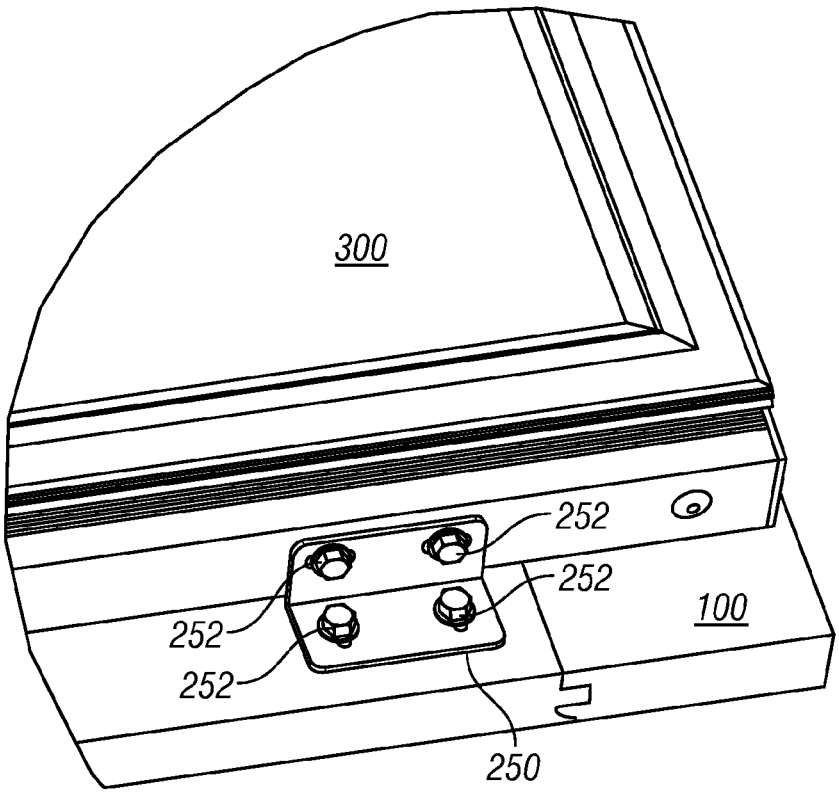
FIG. 10 is a perspective view showing an embodiment of the lower bracket region.

With reference to FIG. 10, a perspective view show an embodiment of the lower bracket region 1000 and a portion of door 300 is generally depicted at 300 and a portion of panel 100 is generally depicted at 100. Bottom bracket 250 can be secured to both panel 100 and door 300 with bottom bracket fasteners 252. This may provide additional stability and fixation for the panel to the door. One skilled in the art will appreciate that bottom bracket 250 may be combined with a door hinge or hinge pin (not shown) to also allow rotational mounting of door 300 to the kitchen appliance cabinet.

Figure 11:
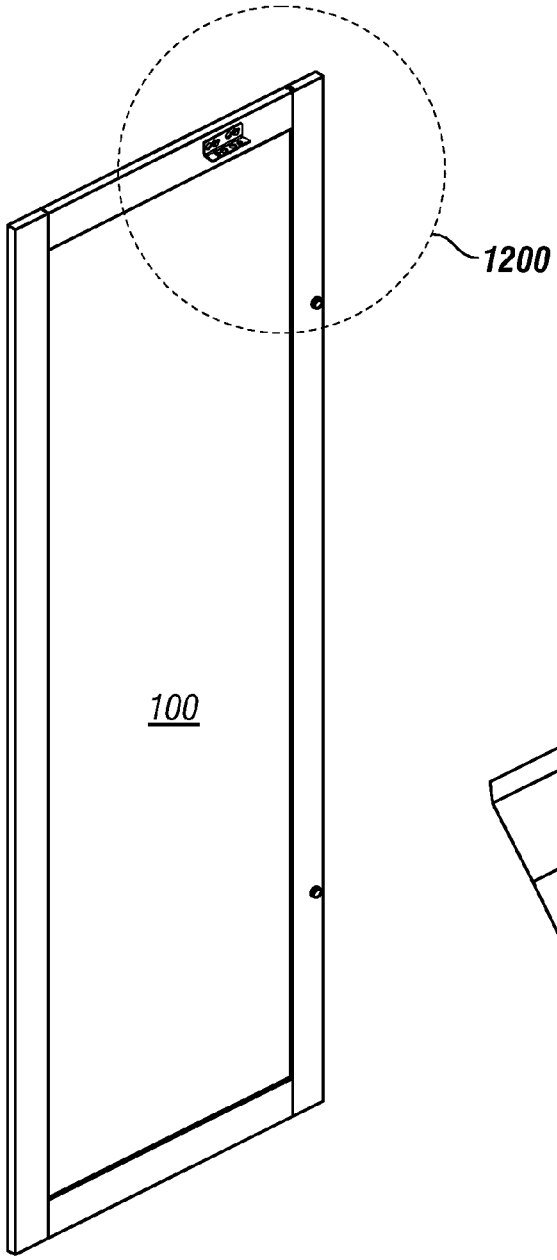
FIG. 11 is a perspective view showing an embodiment of the panel, bracket and spacer lugs.
Figure 12:
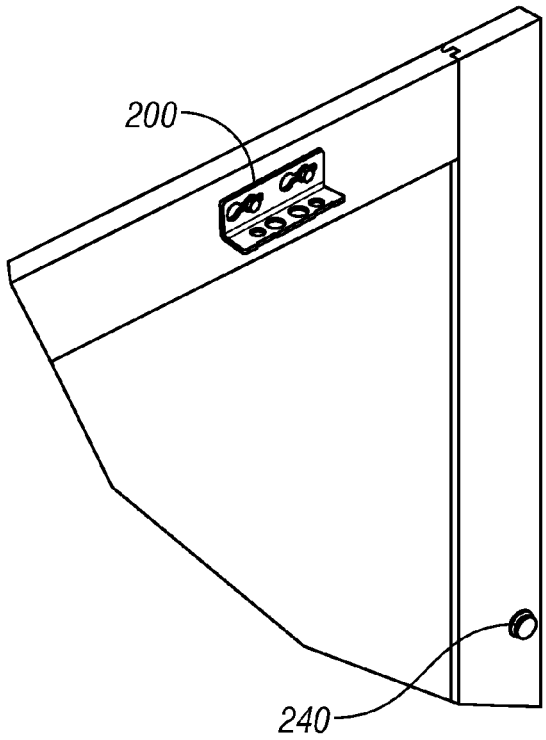
FIG. 12 is a perspective view showing a depiction of the top corner panel view.

With reference to FIG. 11, one can see a perspective view of an embodiment of panel 100. Top panel corner region is generally called out at 1200. FIG. 12 is a closer depiction of top panel corner region 1200. Bracket 200 is shown attached to the panel, as well as one of the panel lugs 240.

Figure 13:
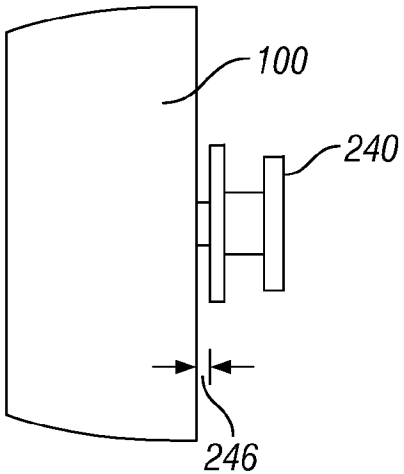
FIG. 13 is a side view of a panel lug.
Figure 14:
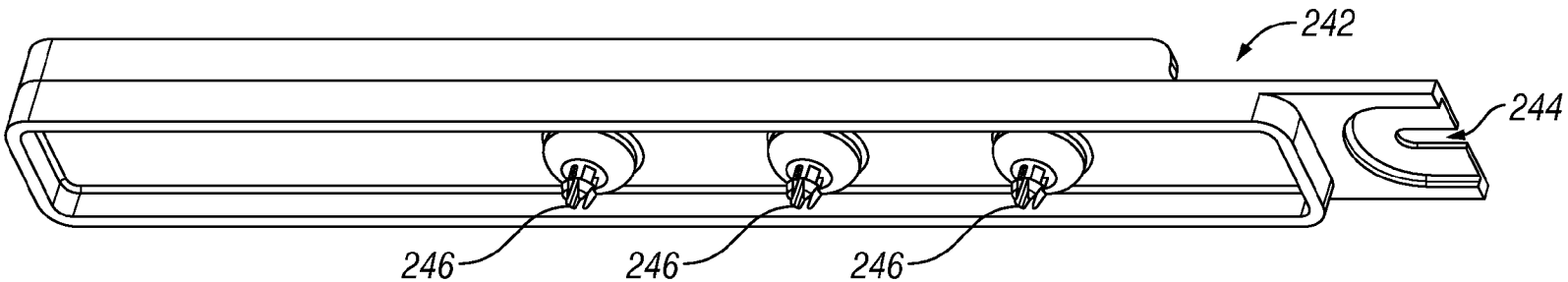
FIG. 14 is a perspective view of a spacer block.

With reference to FIG. 13 panel lug 240 is shown from the side. Panel lug 240 is shown attached to panel 100. Panel lug 240 is shown to include a lug engagement portion 246. With reference to FIG. 14, spacer block is generally depicted at 242. Spacer block 242 includes lug engagement member 244. In this embodiment engagement member 244 is designed to be able to engagingly slide into lug engagement portion 246 of lug 240. This allows spacer block 242 to be inserted into lug 240 to drive the proper gap between panel 100 and door 300. This is done by adjusting the depth of lug 240 is inserted in the panel 100. Lug 240 is adjusted (e.g. by screwing it further into the panel) while engagement member 244 is inserted into lug engagement portion 246. Lug 240 is adjusted until engagement member 244 is reasonably tight, or snug, in between lug 240 and panel 100. Different desired depths can be achieved for various material by using different spacer blocks 242. In some cases it may be desirable to have panels 100 of certain materials to be attached closer to door 300 than panels 100 of other materials. Spacer attachment members 246 can be used to attach spacer block 242 to door 300 (shown in other figures) for storage and/or easy access by the customer or installer.

Figure 15:
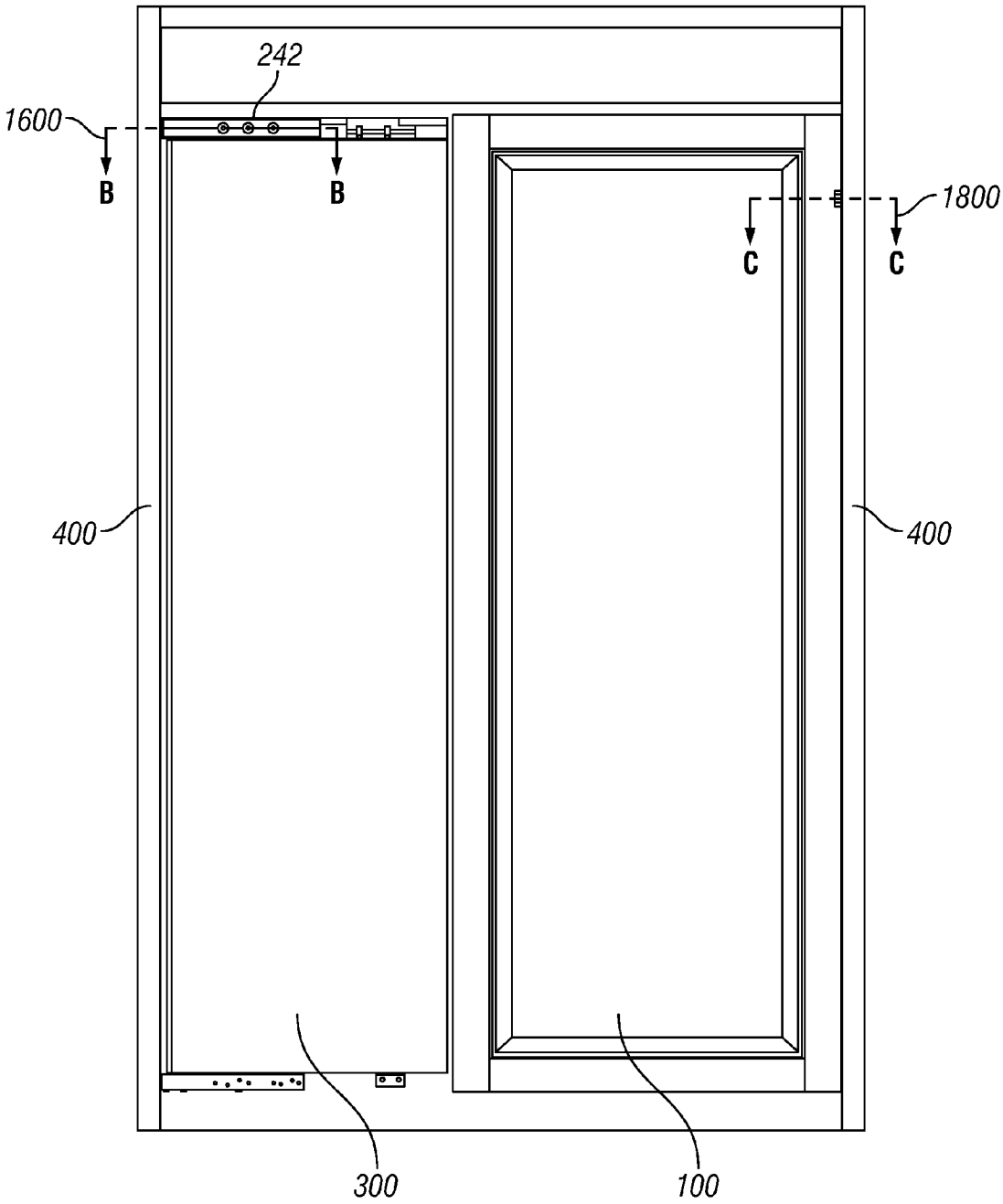
FIG. 15 is a depiction of a refrigerator placed into an opening in a kitchen where the right side shows a panel attached to the door and the left side shows a door without a panel attached. Cutouts B-B and C-C are also depicted

With reference to FIG. 15, a kitchen refrigerator is shown place into a kitchen opening having kitchen opening edges 400. The right side of the refrigerator is shown with panel 100 attached and the left side shows door 300 without a panel. Spacer 242 is shown attached to door 300. Cut-out B-B is generally depicted by 1600 and cut-out C-C is generally depicted by 1800.

Figure 16:
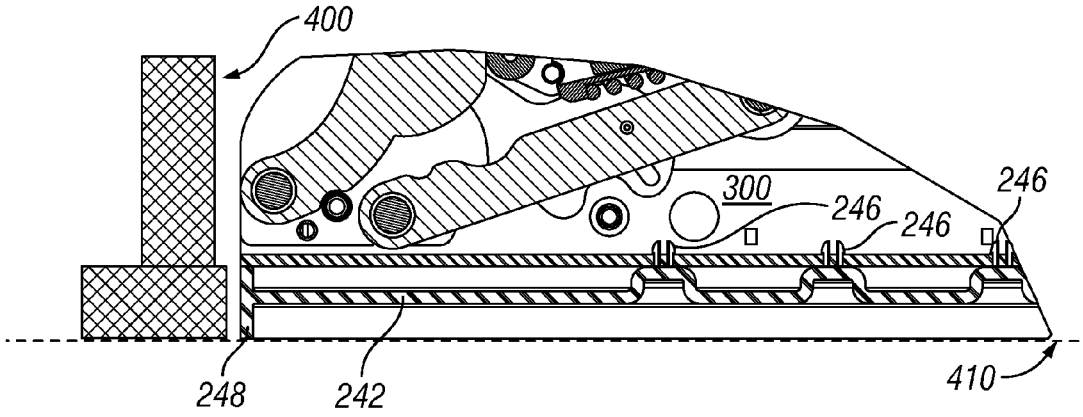
FIG. 16 is a cross-sectional view of cutout B-B.
Figure 17:
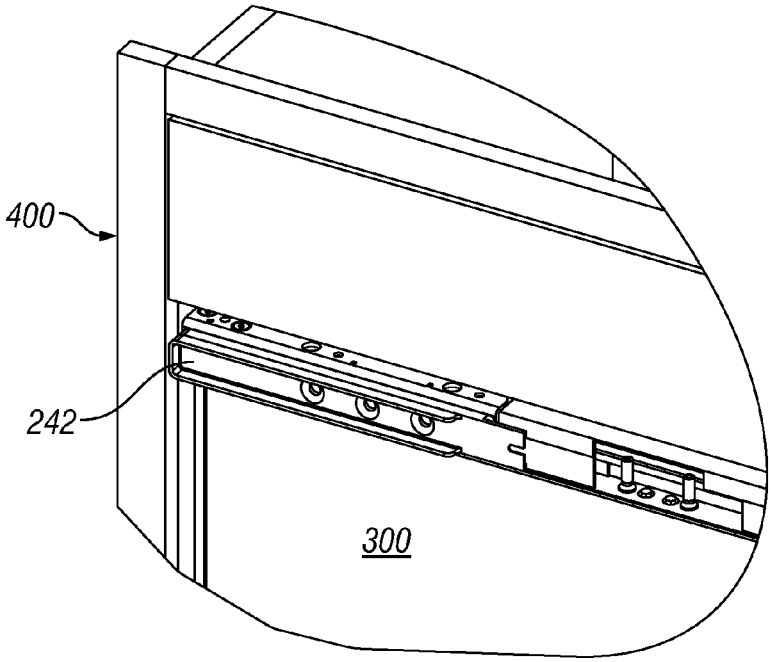
FIG. 17 is a perspective view of a refrigerator in flush alignment with the front edge of a kitchen opening.
Figure 19:
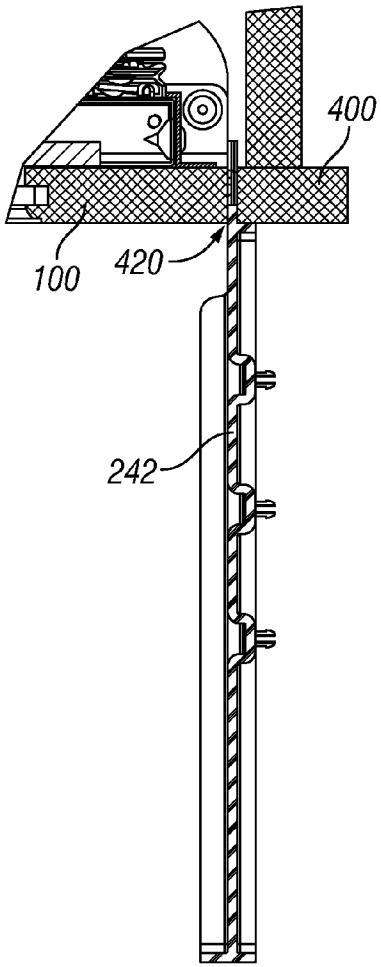
FIG. 19 is a cross-section view of cutout C-C.

With reference to FIG. 16, the cross sectional view of cut-out B-B 1600 is depicted. Spacer block 242 is shown attached to door 300 by spacer attachment members 246. Spacer block 242 includes a portion that is a flush edge indicator 248. This flush edge indicator 248 can be used to ensure flush alignment, generally depicted at 410 is achieved by aligning the a flush edge indicator 248 with the front surface of kitchen opening edge 400. This can be done on each side of the kitchen appliance installed into a kitchen opening. FIG. 17 depicts a perspective view of the spacer block 242 in flush alignment 410 (not depicted in this figure) with the front of kitchen opening edge 400.

Figure 18:
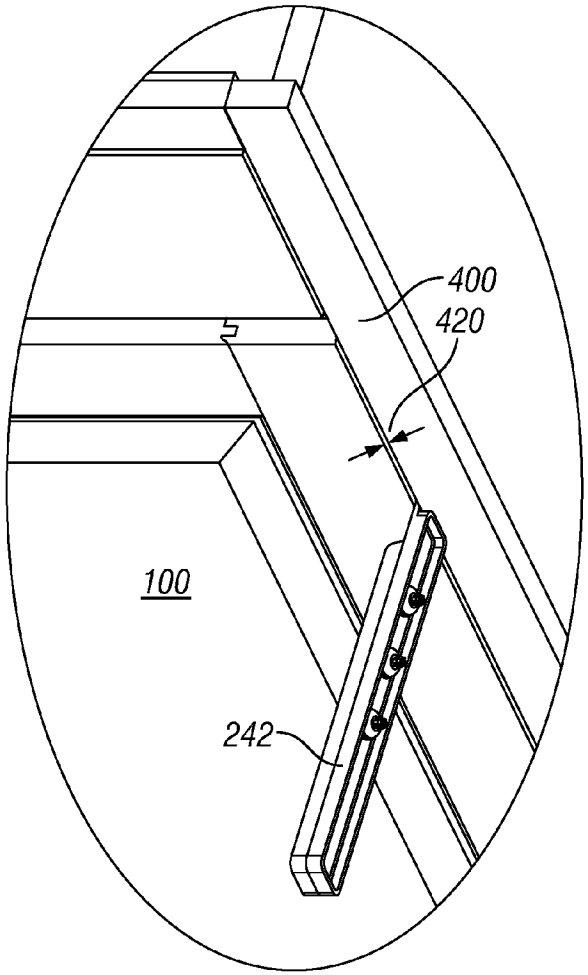
FIG. 18 is a perspective view of a spacer block being used to ensure a correct gap exists between the panel and the interior edge of the kitchen opening.

With reference to FIG. 18, a portion of panel 100 is generally depicted at 100. Spacer 242 is inserted between the edge of kitchen opening 400 and panel 100. Spacer 242 is sized to indicate the desired panel to edge gap when the space is reasonably tight between panel 100 and the edge of kitchen opening 400.

The above description is considered that of the preferred embodiment(s) only. Modifications of the invention will occur to those skilled in the art and to those who make or use the invention. Therefore, it is understood that the embodiment (s) shown in the drawings and described above is/are merely for illustrative purposes and not intended to limit the scope of the invention, which is defined by the following claims as interpreted according to the principles of patent law, including the doctrine of equivalents.

The claimed invention is:

1. A kitchen appliance comprising:

a cabinet, the cabinet having an access opening;

a door, the door proximate to the access opening and having an edge at a top of the door;

a panel, the panel having a front and a back side;

a top bracket having a top bracket door attachment and a top bracket panel attachment arranged in an L shape, where:

the top bracket is adjustably attached to the top edge of the door by the top bracket door attachment, the top bracket is adjustably attached directly to the back side of the panel by the top bracket panel attachment which extends upwardly from a bottom portion of the top bracket door attachment in order to facilitate adjustment of the panel in relation to the door; and a bottom hinge bracket, where the bottom hinge bracket is attached to the cabinet, where the door is mounted on the bottom hinge bracket, where the panel is attached to the bottom hinge bracket, wherein the top bracket door attachment provides a top bracket door adjustment of the panel in relation to the door, said top bracket door adjustment to the door comprises a vertical adjustment and a rotational adjustment; and wherein the top bracket panel attachment provides a top bracket panel adjustment of the panel in relation to the door, said top bracket panel adjustment comprises a horizontal adjustment.

2. The kitchen appliance of claim 1 wherein the top bracket door adjustment comprises two pins, secured to the door.

3. The kitchen appliance of claim 2 wherein the pins comprise threaded bolts and are rotationally secured to the door by nuts.

4. The kitchen appliance of claim 1 wherein the top bracket panel adjustment comprises a slidable attachment to the panel.

5. The kitchen appliance of claim 4 wherein the slidable attachment to the panel comprises a plurality of slots cooperating with at least two protrusions which extend from the panel.

6. The kitchen appliance of claim 5 wherein at least one of the plurality of slots comprise a keyhole and the at least two protrusions comprise screw heads.

7. The kitchen appliance of claim 1 further comprising a bottom bracket where the bottom bracket is attached to the door and is attached to the back side of the panel.

8. The kitchen appliance of claim 1 further comprising, a retention member, where the retention member is in the panel, a handle, where the handle is attached to the front of the panel through the retention member.

9. An appliance comprising;

a door, an external panel, a bracket having a top portion and a bottom portion, wherein the top portion is engaged to the panel with an adjustable engagement including a slot with a keyhole portion, wherein the bottom portion is engaged with a top edge of the door with an adjustable engagement, such that the bottom portion is below the keyhole portion, wherein the adjustable engagements of the top portion to the panel and the bottom portion to the door facilitate adjustment of the panel in relation to the door; and the adjustable engagement to the door comprises a rotationally adjustable engagement.

10. The appliance of claim 9 wherein the adjustable engagement to the panel is substantially horizontal.

11. The appliance of claim 9 wherein the adjustable engagement to the panel comprises a slidable aspect.

12. The appliance of claim 9 wherein the adjustable engagement to the door is substantially vertical.

13. The appliance of claim 9 wherein the adjustable engagement of the bracket to the door and the panel allows for vertical, horizontal and rotational adjustment of the panel in relation to the door.

14. A method of attaching a panel to a kitchen appliance door comprising, providing a plurality of pins at the top of a kitchen appliance door, providing a plurality of protrusions on a back side of a panel and above the pins, orienting a bracket having a pin receiving portion and a protrusion receiving portion so that the protrusion receiving portion is above the pin receiving portion, engaging the pin receiving portion of the bracket to the pins, engaging the protrusion receiving portion of the bracket to the protrusions, adjusting the panel substantially vertically, in relation to the door, by changing an orientation of the protrusions in relation to the bracket, and adjusting the panel substantially horizontally and rotationally, in relation to the door, by changing an orientation of the pins in relation to the bracket.

15. A method of attaching a panel to a kitchen appliance door comprising, providing a single spacer block to assist in alignment of:

a flush fitting of a front face of the panel to a front face of a kitchen opening edge;

a desired gap between a side edge of the panel to the side edge of the kitchen opening;

a desired gap between the panel and the door;

providing a plurality of pins at the top of a kitchen appliance door, providing a plurality of protrusions on a back side of the panel, providing a bracket having a pin receiving portion and a protrusion receiving portion, engaging the bracket to the pins, engaging the bracket to the protrusions, adjusting the panel substantially vertically, in relation to the door, by changing an orientation of the protrusions in relation to the bracket, and adjusting the panel substantially horizontally and rotationally, in relation to the door by changing an orientation of the sins in relation to the bracket.

16. The method of claim 14 wherein the pins are threaded, the step of engaging the bracket to the door comprises threading at least one nut to the threads of at least one of the pins, the step of adjusting the panel substantially horizontally and rotationally in relation to the door comprises rotating the nut about the threads of the pin.

* * * * *